US006622991B2

(12) United States Patent
Steffes

(10) Patent No.: US 6,622,991 B2
(45) Date of Patent: Sep. 23, 2003

(54) PICKET FENCE CAP ASSEMBLY

(75) Inventor: Stephen W. Steffes, McPherson, KS (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 10/080,718

(22) Filed: Feb. 22, 2002

(65) Prior Publication Data

US 2003/0160222 A1 Aug. 28, 2003

(51) Int. Cl.[7] ..... E04H 17/14

(52) U.S. Cl. ..... 256/1; 256/66; 256/65.01

(58) Field of Search ..... 256/65.01, 66, 256/1, 19, 11, 12, 24, 65.02

(56) References Cited

U.S. PATENT DOCUMENTS 5,645,270 A * 7/1997 Lawrence ..... 256/66
2002/0104985 A1 * 8/2002 Lesenskyj ..... 256/65.1
2002/0104986 A1 * 8/2002 Lesenskyj ..... 256/65.1

OTHER PUBLICATIONS

Picket Fence Caps and Clips Product Literature, 2001 LMT–Mercer Group, Lawrenceville, New Jersey.

Picket Fence Caps and Clips Product Literature, TopCaps, Pompano Beach, Florida.

* cited by examiner

*Primary Examiner*—Lynne H. Browne
*Assistant Examiner*—John R. Cottingham
(74) *Attorney, Agent, or Firm*—John F. Letchford; Klehr, Harrison, Harvey, Branzburg & Ellers LLp

(57) ABSTRACT

A clip-on assembly that can resist detachment of a plastic picket cap member from a plastic picket member when significant pulling force is applied to the cap member. The assembly includes a single clip constructed as a bushing-like member whose side walls are preferably provided with at least one outwardly projecting retention barb adapted for secure embedment into the inner side wall surfaces of a picket member when the assembly is inserted therein. The legs of the cap member upon which the clip is installed are very stiff by virtue of being reinforced by plates that resist deflection of the legs when inserted in the clip. The reinforcement plates are preferably dimensioned to inhibit inward flexure of the side walls of the clip and ensure embedment of the retention barb into the picket member.

13 Claims, 2 Drawing Sheets

PICKET FENCE CAP ASSEMBLY

FIELD OF THE INVENTION

The present invention relates in general to fence structures and in particular to a picket fence structures.

BACKGROUND OF THE INVENTION

A wide variety of fencing structures have long been used to separate or enclose areas of industrial, commercial, residential and other properties. Common examples include stockade, chain link, wire, split rail and picket fencing. Fencing products may be fabricated from many different type of materials such as metal, wood, plastics and combinations or composites thereof. Among these, plastic and plastic-based fencing products are becoming increasingly popular. This is because they are relatively easy and inexpensive to manufacture and because consumers appreciate their attractiveness, low-maintenance, durability and competitive cost.

Plastic picket fencing represents a significant segment of the fencing industry. The pickets of a typical plastic picket fence are designed to resemble wooden pickets but are usually made from two pieces, the picket member and an upwardly pointed cap member that may be adhesively attached or mechanically fastened to the picket member. A disadvantage of using glue to attach the cap to the picket is that it can be messy and unsightly if applied improperly. Moreover, adhesives tend to become brittle and lose their bonding strength when exposed to the elements for extended periods of time. As such, after the passage of time it is not unusual for an adhesively attached cap to become relatively easily detachable from its picket. Such loosened caps can then become separated from their pickets by vandals or by something as benign as a strong wind, thereby leaving the fence in an incomplete, unsightly condition.

Mechanical fixation is an alternative to adhesive attachment of a plastic cap member to a plastic picket fence member. Mechanical fixation involves the creation of a friction or interference fit between the cap and picket members. Examples of picket fence cap assemblies that utilize such a friction fit principle are marketed by LMT Products Corporation ("LMT") of Lawrenceville, NJ. These assemblies comprise the cap member itself as well as a pair of stainless steel metal clips. The molded plastic cap member includes a plurality of downwardly depending legs that are adapted for insertion into the open top of a plastic picket. The picket is a typically a predetermined length of hollow extruded rigid polyvinyl chloride (PVC), polycarbonate, acrylic ester-modified styrene acrylonitrile terpolymer (ASA) or other plastic material having a rectangular cross sectional configuration designed to impart to the picket the shape of a wooden board or plank. Each of the metal clips includes a barb that functions to securely attach the clips to the cap member when the clips are press fitted onto the bottoms of legs disposed at opposite ends of the cap member. The clips include outwardly and upwardly inclined flat tabs or fingers that, when the cap member is inserted into the picket member, frictionally engage the inner surfaces of opposite end walls of the picket member. It is this frictional engagement of the clips with the picket member which serves to retain the: cap member on the picket member.

As presently constructed, the LMT clip-on picket fence cap assemblies cap members can be extracted from their pickets by the exertion of about 8–15 lbs. tensile or pulling force. While this level of resistance is sufficient to prevent detachment of the cap member as a result of a strong wind, it would not be enough to deter a determined vandal.

An advantage exists, therefore, for a clip-on picket fence cap assembly that can resist detachment of a plastic picket cap member from a plastic picket member when significant pulling force is applied to the cap member.

SUMMARY OF THE INVENTION

The present invention provides a clip-on picket fence cap assembly that can resist detachment of a plastic picket cap member from a plastic picket member when significant pulling force is applied to the cap member. The assembly overcomes the deficiencies of existing products in several ways. First, the invention proposes a single clip constructed as a bushing-like member whose side walls are preferably provided with at least one outwardly projecting retention means adapted for secure embedment into the inner side wall surfaces of a picket member when the cap assembly is inserted therein. The legs of the cap member upon which the clip is installed are very stiff by virtue of being reinforced by plates that resist deflection of the legs when inserted in the clip. This is contrasted with conventional cap members whose unreinforced legs flex inwardly upon insertion into a picket, thereby inhibiting the metal tabs of the clips from "hooking" or "biting" into the inner walls of the extruded picket. The reinforcement plates are preferably dimensioned to inhibit inward flexure of the side walls of the clip and ensure embedment of the retention means into the picket member. The resultant assembly is substantially stiffer and stronger than presently available clip-on picket fence cap assemblies. Because of this, its clips very firmly embed themselves into a picket and make it very difficult to extract the cap from the picket by simply pulling on the cap.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 3:
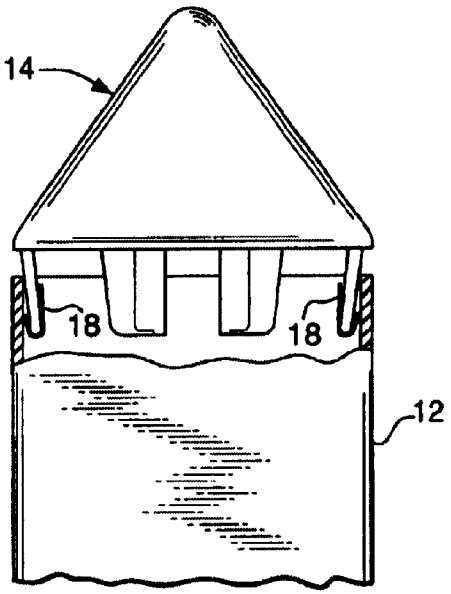
FIG. 3 (Prior Art)
FIG. 3 is a partially broken, side elevation view of the assembly of FIG. 2 installed in a plastic picket.

Referring to the drawings, wherein like references indicate like or similar elements throughout the several views, there is shown a conventional plastic fence picket 10 in assembled condition. Picket 10 includes a hollow, typically extruded, plastic picket member 12 and a molded plastic cap member 14. The picket member 12 may be of any desired length and may be square or, more commonly, rectangular in cross-section. It may have outer width and thickness dimensions ranging from about 1½ to about 6 inches in width and from about ¾ to about 1½ inches in thickness. The base of the top or finial portion of the cap member 14 normally corresponds in size and shape to the outer width and thickness dimensions of the picket member 12. And, the top or finial portion of the cap member 14 may be formed as a complete (as illustrated) or truncated upwardly tapering pyramid such that, when the cap member 14 is inserted into the picket member 12, the resultant picket 10 simulates the shape of a conventional wooden picket. As stated previously, cap member 14 may be adhesively attached to or clipped onto the picket member 12.

Picket member 12 and cap member 14 may be formed entirely of plastic such as PVC, polycarbonate, ASA polyvinyl chloride or other rugged plastics. Alternatively, they may be a composite of plastic and natural and/or artificial fibrous materials to enhance the strength and/or paintability of the products. As is known, the plastic may also include ingredients for promoting weather resistance, UV radiation resistance, mildew resistance, fading or discoloration resistance and/or for imparting other beneficial properties to the products.

Figure 2:
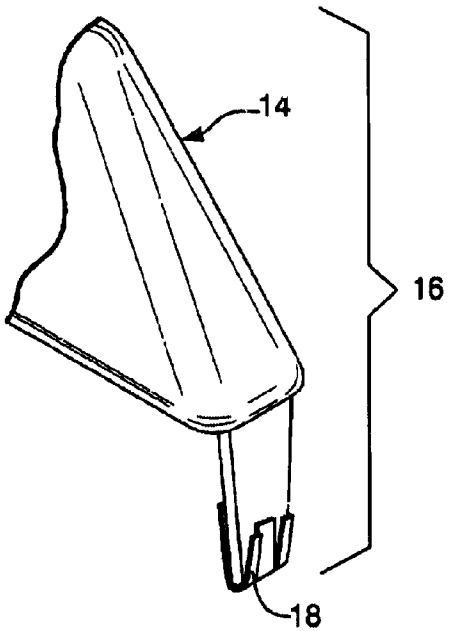
FIG. 2 (Prior Art)
FIG. 2 is an isometric view of a clip-on picket fence cap assembly known in the art.
Figure 1:
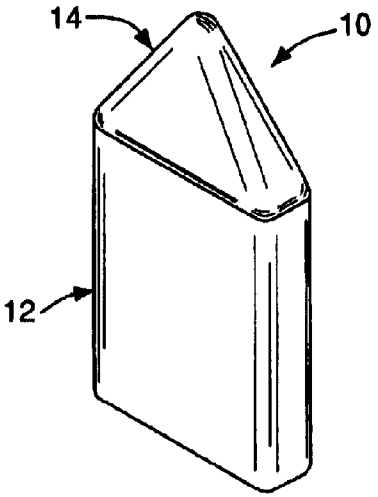
FIG. 1 (Prior Art)
FIG. 1 is an isometric view of a plastic fence picket in assembled condition.

FIGS. 2 AND 3 show the structural aspects of a conventional clip-on picket fence cap assembly 16 that is known in the art. Assembly 16 comprises a molded plastic cap member 14 that is affixable to an extruded plastic picket member 12 via a pair of metal clips 18. Clips 18 are typically fabricated from stainless steel or other corrosion-resistant metal or metal alloy. The cap member 14 includes a plurality of downwardly depending side legs 20 and end legs 22 that are adapted for insertion into the open top of picket member 12. Each clip 18 includes a substantially U-shaped central portion which is adapted to receive the bottom of a respective one of the end legs 22 disposed at opposite ends of cap member 14. Clips 18 are press fitted onto end legs 22 and each clip includes a barb (not illustrated) that functions to securely retain the clip on its associated cap member end leg 22. Clips 18 include outwardly and upwardly inclined flat tabs or fingers 26. As illustrated in FIG. 3, when the cap member 14 is inserted into the picket member 12, end legs 22 flex inwardly (the degree of flexure being exaggerated for emphasis) while tabs 26 frictionally engage the inner surfaces 28 of the opposite end walls 30 of the picket member 12 in order to retain the cap member on the picket member. At present, the cap member 14 of a clip-on type picket fence cap assembly constructed generally in accordance with that shown in FIGS. 2 AND 3 can be extracted from picket member 12 with about 15 lbs. of pulling force or less.

Figure 4:
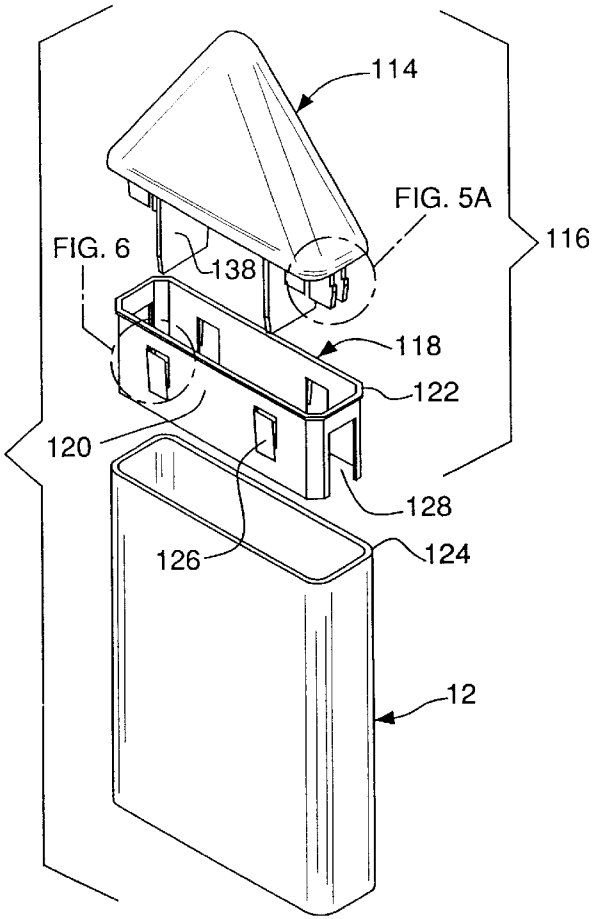
FIG. 4 is an exploded isometric view of a plastic picket and a clip-on picket fence cap assembly according to the present invention.

FIG. 4 is an exploded isometric view of a plastic picket 12 and a clip-on picket fence cap assembly 116 according to the present invention. Assembly 116 preferably comprises a molded plastic cap member 114 that is affixable to an extruded plastic picket member 12 via a metal clip 118. Clip 118 is desirably fabricated from stainless steel or other corrosion-resistant metal or metal alloy. According to a presently preferred embodiment, clip 118 is constructed as a bushing-like member including a sleeve portion 120 having contiguous side walls and end walls and bounded an upper edge thereof by an outwardly directed flange portion 122. When the assembly 116 is fully inserted in the open upper end of picket member 12 the bottom surface of flange portion 122 rests atop the upper edge 124 (FIG. 4) of picket member 12.

Figure 6:
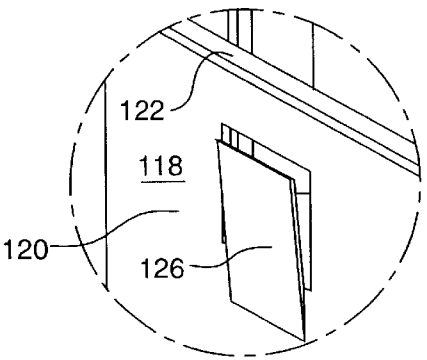
FIG. 6 is an enlarged view of a portion of a clip of the clip-on picket fence cap assembly according to the present invention.

As shown in FIGS. 4 and 6, the side walls of sleeve portion 122 of clip 118 include at least one or, more preferably, a plurality of outwardly projecting retention means 126 for promoting secure embedment of the clip into the inner surfaces of the side walls of picket member 12 when the cap assembly 116 is inserted therein. According to a presently preferred embodiment, retention means is 126 constructed as at least one outwardly projecting barb that is stamped from the material of the clip itself during formation thereof. The end walls of sleeve portion 122 of clip 118 also preferably include gaps 128 adapted for engagingly receiving the end legs of cap member 114 in the manner described below.

Figure 5A:
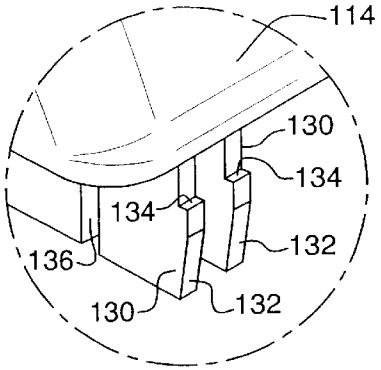
FIG. 5A is an enlarged view of a portion of the cap member of the clip-on picket fence cap assembly according to the present invention.
Figure 5:
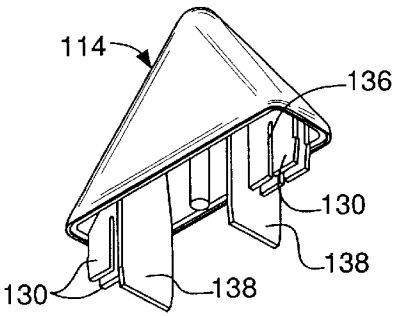
FIG. 5 is an isometric view of the cap member of the clip-on picket fence cap assembly according to the present invention.

As perhaps most clearly depicted in FIGS. 5 and 5A, cap member 114 includes at least one end leg 130 downwardly depending from each end of the top or finial portion of the cap member. The end legs 130 are adapted for insertion into the open top of clip 118. More preferably, cap member 114 includes a pair of end legs 130 at each end thereof spaced apart from one another a sufficient distance whereby the end legs are closely received between the side edges of a respective end wall gap 128 of clip 130 when the cap member is inserted into the clip. Each end leg 130 preferably has a slightly outwardly sloped facing edge 132 that collectively serve as a cam surfaces to spread the end walls of clip 118 apart from one another during insertion of the cap member 114 into the clip. At their lowermost points, the distance between the facing edges 132 of end legs 130 is less than the distance between the end walls of clip 118 to facilitate insertion of the end legs into the clip. Additionally, each end leg 130 desirably includes an undercut area that establishes a ledge 134 that interlocks with the upper edge its associated clip end wall gap 128 to interlock the cap member 114 and clip 118.

To reduce the possibility of damaging the end legs 130 during their insertion into the clip 118, each leg is preferably formed to include a stress relief means 136 such as a narrow slot or notch. Stress relief-means 136 allows a small degree of compressive flexure in end legs 130 without which the end legs could possibly harmfully bend or break. Cap member further 114 preferably includes integral reinforcement means 138 that reinforce the cap assembly in one or both of its longitudinal (width) and transverse (thickness) dimensions. In a preferred embodiment, reinforcement means 138 comprises a downwardly depending plate that is disposed closely proximate to or, more preferably, is integrally connected with the end leg(s) 130 at a respective end of the cap member 114. Reinforcement means 138 preferably has a width that is slightly less than the distance between the side walls 120 of clip 118 such that the reinforcement means 138 fits in close tolerance within the clip 118 when inserted therein. As a practical matter, this close tolerance enables reinforcement means 138 to resist inward flexure of the side walls 120 of clip 118 when the cap assembly 116 is inserted into the picket 12. The stiffened side walls 120 of clip 118, in turn, force the barbs of retention means into secure "hooking" or "biting" engagement into the inner walls of the extruded picket.

From the foregoing, it will be appreciated that the resultant picket fence cap assembly 116 of the present invention is substantially stiffer and stronger than clip-on picket fence cap assembly 16 of FIGS. 2 AND 3. Because of this, clip 118 very firmly embeds itself into picket member 12 and make it very difficult to extract the cap member 114 from the picket member by simply pulling on the cap member.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A cap assembly for a hollow plastic fence picket member, said assembly comprising:

a plastic cap member including a top portion and end legs downwardly depending from said top portion and adapted for insertion into a picket member; and a clip including a sleeve portion having contiguous side walls and end walls and bounded on an upper edge thereof by an outwardly directed flange portion having a bottom surface adapted to rest atop an upper edge of a picket member, said clip further including retention means for contacting inner surfaces of side walls of a picket member when the cap assembly is inserted therein.

2. The cap assembly of claim 1 wherein said clip is fabricated from metal.

3. The cap assembly of claim 1 wherein said cap member comprises means for resisting inward flexure of said end legs.

4. The cap assembly of claim 1 wherein said cap member comprises means for resisting inward flexure of said side walls of said clip.

5. The cap assembly of claim 1 wherein said retention means comprises at least barb.

6. A plastic fence picket comprising:

a hollow plastic fence picket member; and a cap assembly for said picket member comprising:

a plastic cap member including a top portion and end legs downwardly depending from said top portion and adapted for insertion into a picket member; and a clip including a sleeve portion having contiguous side walls and end walls and bounded on an upper edge thereof by an outwardly directed flange portion having a bottom surface adapted to rest atop an upper edge of a picket member, said clip further including retention means for contacting inner surfaces of side walls of a picket member when the cap assembly is inserted therein.

7. The picket of claim 6 wherein said clip is fabricated from metal.

8. The picket of claim 6 wherein said cap member comprises means for resisting inward flexure of said end legs.

9. The picket of claim 6 wherein said cap member comprises means for resisting inward flexure of said side walls of said clip.

10. The picket of claim 6 wherein said retention means comprises at least barb.

11. In a cap assembly for a hollow plastic fence picket member, the assembly comprising a plastic cap member including a top portion and end legs downwardly depending from said top portion and adapted for insertion into the picket member, a clip adapted to be carried by the end legs and comprising:

a sleeve portion having contiguous side walls and end walls and bounded on an upper edge thereof by an outwardly directed flange portion having a bottom surface adapted to rest atop an upper edge of a picket member, said clip further including retention means for contacting inner surfaces of side walls of a picket member when the cap assembly is inserted therein.

12. The clip of claim 11 wherein said clip is fabricated from metal.

13. The clip of claim further comprising means for interlocking said clip onto the end legs.

* * * * *